United States Patent [19]

Smith et al.

[11] Patent Number: 4,480,774

[45] Date of Patent: Nov. 6, 1984

[54] CROSSBOW CARRYING CASE

[76] Inventors: James G. Smith, 1431 New St., Union Grove, Wis. 53182; Lawrence J. Ojstrsek, 1674 Highway 175, Hubertus, Wis. 53033

[21] Appl. No.: 462,606

[22] Filed: Jan. 31, 1983

[51] Int. Cl.[3] ..... A45C 13/26; A45C 13/36; B65D 85/00

[52] U.S. Cl. ..... 224/205; 124/25; 124/41 R; 190/109; 190/119; 206/315.1; 206/315.11; 206/317; 224/202; 224/916; 294/152; 383/16; 383/97; 383/119; 383/907

[58] Field of Search ..... 224/202, 916, 205; 206/317, 315.1; 150/52 G; 190/901, 115, 109, 119, 110, 124, 111; 383/119, 105, 907, 97, 16; 124/24, 41 R; D3/36, 77; 294/152

[56] References Cited

U.S. PATENT DOCUMENTS

| | | | |
|---|---|---|---|
| D. 182,868 | 5/1958 | Arnold | D3/36 |
| D. 238,011 | 12/1975 | Canton | D3/36 |
| D. 267,522 | 1/1983 | Stark | D3/77 X |
| 1,091,280 | 3/1914 | Brauer | 206/315.1 X |
| 2,531,550 | 11/1950 | Bradley et al. | 206/317 |
| 2,881,817 | 4/1959 | Brion | 124/23 A |
| 3,058,505 | 10/1962 | Emmett | 224/916 |
| 3,678,611 | 7/1972 | Files | 224/202 X |
| 4,002,236 | 1/1977 | Tolleson | 206/317 X |
| 4,023,800 | 5/1977 | Haggerty | 150/52 G X |
| 4,262,798 | 4/1981 | Raab | 150/52 G X |

*Primary Examiner*—Allan N. Shoap

*Attorney, Agent, or Firm*—Michael, Best & Friedrich

[57] ABSTRACT

The crossbow carrying case includes opposed based and cover sections having a generally triangular shape and interconnected along one edge to permit movement of the cover section between an open position and a closed position wherein the cover and base sections are in facing relationship and cooperate to define a compartment for receiving an assembled crossbow ready for use. When in the closed position, the base and cover sections are releasably fastened together along the other two edges by a zipper or the like. The crossbow is releasably held in place inside the compartment by a pair of longitudinally spaced tie down straps secured to the inner surface of the base section at locations corresponding to the narrowed hand grip portion of the crossbow stock and the area immediately forward of the forehand grip of the crossbow stock. These tie down straps include opposed free end portions having a combined length sufficient to surround the respective portions of the crossbow and gripping means, such as mating strips of Velcro material, adapted to permit the free end portions to be adjustably and releasably grip each other. A quiver carrying arrows and a cocking mechanism can be releasably secured to the base section by similarly arranged tie down straps. Crossbow accessories can be stored in an expandable pocket secured to the base section and having a closeable flap. The case can be carried by a side handle, and end handle or a shoulder strap.

14 Claims, 5 Drawing Figures

CROSSBOW CARRYING CASE

BACKGROUND OF THE INVENTION

This invention relates to carrying cases and, more particularly, to carrying cases for crossbows.

As the use of crossbows for hunting and other sporting purposes has become more widespread, there is an increased need for an inexpensive case for conveninently transporting and/or storing a completely assembled crossbow ready for use and possibly including accessories, such as a scope, bow fishing reel, arrow tracker, cocking stirrups, etc. Such a carrying case desirably should also be capable of carrying and/or storing accessories, such as a quiver carrying arrows, a cocking mechanism, broadhead and allen wrenches, bow string wax, extra bow string, extra arrowheads and the like. This need is accentuated by legislation in some states requiring crossbows to be enclosed in some sort of case or container while being transported in a vehicle. Applicants are unaware of any existing carrying cases suitable for completely satisfying this need.

SUMMARY OF THE INVENTION

A primary object of the invention is to provide an inexpensive case for conveniently transporting and/or storing a completely assembled crossbow ready for use.

Another object of the invention is to provide such a carrying case which also is capable of transporting and/or storing crossbow accessories.

A further object of the invention is to provide such a carrying case including means for conveniently securing the crossbow and crossbow accessories in place.

Other objects, aspects and advantages of the invention will become apparent to those skilled in the art upon reviewing the following description, the drawing and the appended claims.

The crossbow carrying case provided by the invention includes opposed base and cover sections having a generally triangular shape, an end edge portion and a pair of side edge portions joined at one end and diverging toward the end portion. The base and cover sections are interconnected along one of the edge portions to permit movement of the cover section between a closed position wherein the base and cover sections are in facing relationship and cooperate to define a compartment for receiving an assembled crossbow and an open position wherein the cover section is moved away from the base section to permit access to the crossbow. Retainer means is provided for releasably securing the crossbow to the base section inside the compartment. Similar retainer means can be provided for releasably securing a quiver carrying arrows and a cocking mechanism to the base section inside the compartment. Fastener means, such as a zipper, is provided for releasably fastening the base and cover sections together along two of the edge portions when the cover section is in the closed position.

In one embodiment, the carrying case is made from a flexible material, such as canvas, and a first pair of longitudinally spaced tie down straps are secured to the inner surface of the base section at locations corresponding to the vicinity of the narrowed hand grip section of the crossbow stock and to the vicinity of the portion of the crossbow immediately forward of the forehand grip of the crossbow stock. Each of the crossbow tie down straps have opposed free end portions with a combined length sufficient to surround respective portions of the crossbow and gripping means is provided on the free end portions of the tie down straps so that the free end portions can adjustably and releasably grip each other to hold the crossbow in place. Similar tie down straps can be used as the retainer means for securing a quiver carrying arrows and a cocking mechanism.

In one embodiment, a longitudinally extending strip of wear resistant material is provided on the inner surface of the base section and on the inner surface of the cover section at a location corresponding to that of the crossbow stock when the crossbow is secured on the base section.

DESCRIPTION OF THE PREFERRED EMBODIMENTS

Figure 2:
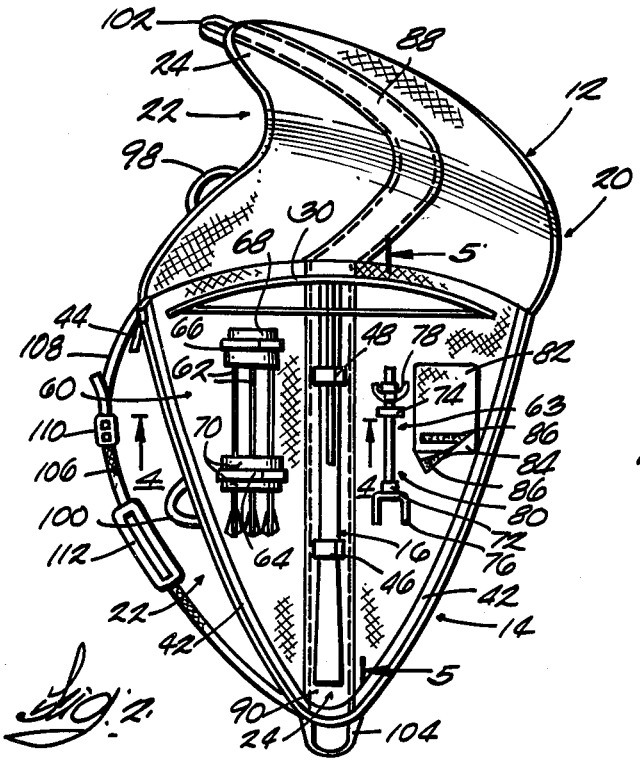
FIG. 2 is a plan view of the carrying case with the cover section in an open position to afford access to the crossbow and crossbow accessories.

Illustrated in the drawing is a crossbow carrying case 10 embodying the invention. In the specific embodiment illustrated, the carrying case 10 includes two sheets or panels of a water repellant, flexible material, such as canvas, leather or a vinyl plastic, having the general shape of an isosceles triangle and joined together along one edge to form opposed cover and base sections 12 and 14 which, when in facing relationship, cooperate to define a compartment for receiving an assembled crossbow 16 ready for use and including a scope 17 and other possible accessories such a bow fishing reel, arrow tracker, cocking stirrups and the like (not shown). The cover and base sections 12 and 14 have an end edge portion 18 and side edge portions 20 and 22 which are of the same length, are joined at one end 24 and diverge toward the end edge portion 18.

The cover and base sections 12 and 14 can be made from a single sheet of material folded over upon itself; however, each preferably is formed from a separate sheet and the end edge portion 18 is stitched or otherwise suitably fastened to a narrow strip or gusset 26 which forms one end of the carrying case 10. Two or more sheets can be used for the cover and base sections, but this would require multiple cutting and stitching or bonding operations and, therefore, is less desirable.

The sheets or panels forming the cover and base sections 12 and 14 have a width approximating, but somewhat wider than, the length of the bow portion 30 of the crossbow 16 and a length approximating, but somewhat longer than, the overall length of the crossbow stock 32.

Figure 1:
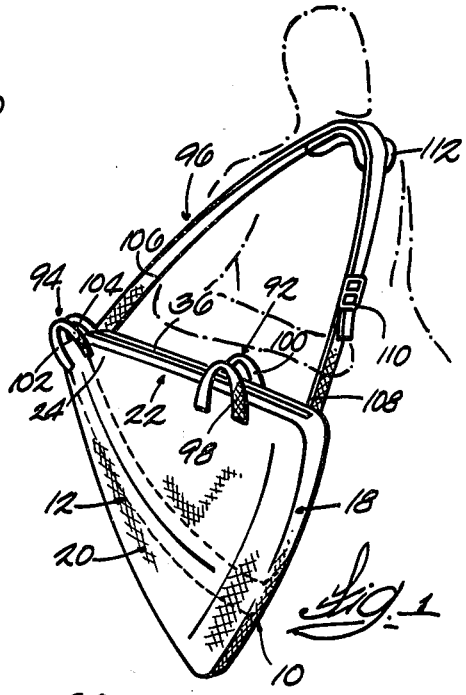
FIG. 1 is a perspective view of a crossbow carrying case of the invention illustrating the case being carried by a shoulder strap.
Figure 3:
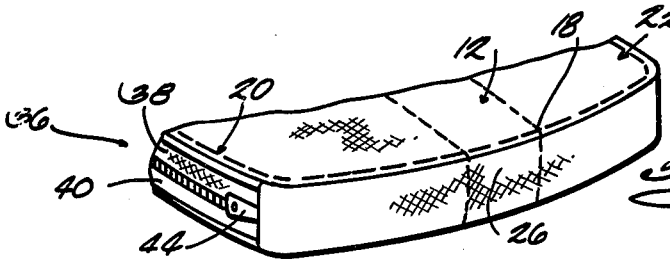
FIG. 3 is a fragmentary, perspective view of the end of the carrying case with the cover section in the closed position.
Figure 4:
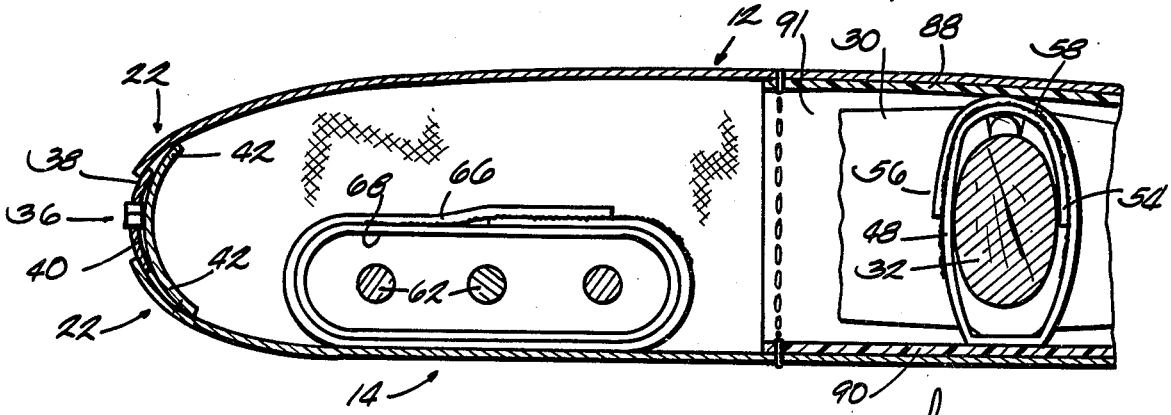
FIG. 4 is an enlarged sectional view taken generally along line 4—4 in FIG. 2.

Fastener means are provided for releasably fastening the cover and base sections 12 and 14 together when the cover section 12 is in a closed position in facing relationship with the base position 14 as shown in FIGS. 1 and 4. In the specific embodiment illustrated, a single heavy duty zipper 36, extending along substantially the entire length of the side edge portions 20 and 22, is provided for this purpose. The zipper 36 includes tape portions 38 and 40 suitably attached, such as by stitching, to the free side edges of the cover and base sections 12 and 14, respectively. Attached to the interior of the base section 14 and extending along the side edges of the base section 14 and behind the zipper 36 is a zipper flap 42 which serves to minimize the zipper slide 44 from catching during zipping and unzipping operations. Other suitable fastener means, such as snaps or mating strips of Velcro material, can be used to releasably fasten the cover and base sections together.

Figure 5:
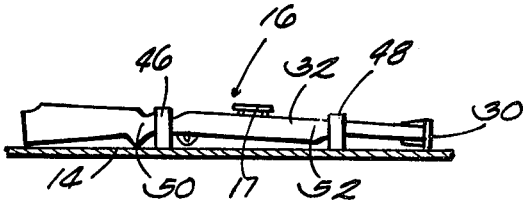
FIG. 5 is a sectional view taken generally along line 5—5 in FIG. 2.

When the zipper 36 is completely unzipped, the cover section 12 can be folded back to an open position as shown in FIG. 2 to afford full access to the crossbow 16. The crossbow 16 is retained in place inside the carrying case 10 (with the stock 32 in the upright position) by a pair of longitudinally spaced, tie down straps 46 and 48 secured to the inner surface of the base section 14 by stitching or other suitable means. As best illustrated in FIG. 5, the tie down strap 46 is located in a vicinity corresponding to the narrowed hand grip portion 50 of the crossbow stock 32 and the tie down strap 48 is located in a vicinity corresponding to the area immediately in front of the forehand grip portion 52 of the crossbow stock 32.

The free end portions 54 and 56 of the crossbow tie down straps (see FIG. 4 which shows the tie down strap 48 only) have a length sufficient to surround the respective portion of the crossbow stock 32 when it is in an upright position and include a gripping means for releasably and adjstably gripping each other to snugly secure the crossbow in place on the base section 14. In the specific embodiment illustrated, strips of mating Velcro material 58 are attached to the outer surface of one free end portion 54 and the inner surface of the other free end portion 56. Other gripping means, such as a strap buckle, can be used.

By locating the crossbow tie down straps 46 and 48 in the above-described locations and providing the free end portions thereof with adjustable gripping means, longitudinal movement, as well as lateral movement, of the crossbow relative to the base section 14 is minimized.

In the specific embodiment illustrated, similar retainer means are provided for securing a quiver 60 carrying arrows 62 and a cocking mechanism 62 in place inside the carrying case. More specifically, a pair of longitudinally spaced, tie down straps 64 and 66 are suitably secured to the inner surface of the base section 14 at locations laterally spaced from one side of the crossbow tie down straps 46 and 48 and generally corresponding to the bottom portion 68 and the arrow retainer portion 70 of the quiver 60. The free end portions of the quiver tie down straps 64 and 66 are long enough to surround these parts of the quiver 60 and include mating strips of Velcro material like the crossbow tie down straps.

Suitably secured to the inner surface of the base section 14 next to the cocking mechanism tie down straps 72 and 74 is an expandable pocket 82, preferably made from the same cloth material as the cover and base sections, for storing accessories, such as bow string wax, extra bow string, broadhead and allen wrenches, extra arrowheads and the like. The pocket 82 has a closable flap 84 which preferably includes a suitable fastener means, such as mating strips of Velcro material 86, snaps or the like for releasably fastening the flap in the closed position.

Longitudinally extending strips of a wear resistant material 88 and 90, such as a vinyl plastic material, are suitably attached to the inner surfaces of the cover section 12 and the base section 14, respectively, to minimize wear from rubbing against the crossbow 16. The wear strips 88 and 90 preferably extend substantially the full length of the cover and base sections, i.e., from the region of the juncture of the side edge portions 20 and 22 to the end edge portion 18, so as to maximize wear protection.

As best shown in FIG. 4, carrying cases to be used for crossbows including cocking stirrups preferably are provided with a strip of wear resistant material 91, such as leather, which is suitably attached to the inner surface of the end gusset 26 at a central location to minimize wear from rubbing against the cocking stirrups.

The carrying case 10 can be carried by a side handle 92, an end handle 94 or a shoulder strap 96 whichever is more comfortable or convenient for the user. The side and end handles 92 and 94 can be made from a flexible material, such a cloth or leather, or a rigid material, such as a high strength synthetic plastic material, and the shoulder strap 96 is made from a flexible material, such as cloth or leather.

In the specific embodiment illustrated, the side handles 92 include a pair of straps 98 and 100 made from a cloth material, such as nylon webbing. The straps 98 and 100 are suitably attached to the outer surface of the cover section 12 and the base section 14, respectively, at a central location generally corresponding to the center of gravity of the carrying case 10 containing a crossbow, a quiver carrying arrows, a cocking mechanism and accessories. The end handles 94 include a pair of straps 102 and 104 made from a cloth material, such as nylon webbing. The straps 102 and 104 are suitably attached to the outer surfaces of the cover section 12 and the base section 14, respectively, in the region near the juncture 24 of the side edge portions 20 and 22.

The shoulder strap 96 includes separate straps 106 and 108 made from a cloth material, such as nylon webbing. One end of the strap 106 is suitably attached to the outer surface of the base section 14 near the juncture 24 of the side edges 20 and 22. One end of the strap 108 is suitably attached to the outer surface of the base section 14 near the juncture between the side edge portion 22 and the end edge portion 18. The unattached end of the strap 106 is threaded through an adjustment buckle 110 fastened to the unattached end of the strap 108. A shoulder pad 112 made from leather or the like is threaded onto the strap 106.

The inner surfaces of the cover and base sections can be lined with a soft padding material, such as a fleece lined padding, for protection against scratching of the crossbow. Such a padded lining is more applicable to cases made from a vinyl plastic material and other similar harder surfaced materials.

While a preferred embodiment of the carrying case constructed from a flexible material has been described in detail, it can be made from a rigid material, such as a high strength synthetic plastic material, Fiberglas or the like. When constructed from such a material, the cover and base sections have the same general shape, the end edge portions are connected together by one or more hinges to facilitate pivotal movement of the cover between the open and closed positions, and the cover and base sections are releasably fastened together with one or more suitcase type latches. Tie down straps similar to those described above can be used for securing the crossbow, a quiver carrying arrows and a cocking mechanism to the base section. Also, a pocket similar to that described above can be provided. A layer of soft padding, such as a polyurethane foam material, can be provided on the inner surfaces of the cover and base sections to provide protection against scratching of the crossbow and to further restrain movement of the crossbow.

From the foregoing description, one skilled in the art can easily ascertain the essential characteristics of the invention and, without departing from the spirit of scope thereof, make various changes and modifications to adapt it to various usages.

We claim:

1. A carrying case for an assembled crossbow having a stock, said case comprising opposed base and cover sections having a generally triangular shape, an end edge portion and a pair of side edge portions diverging toward said end edge portion and each having opposite ends, a first end joining said end edge portion and a second end joining said second end of the other side edge portion;

means interconnecting said base and cover sections along one of said edge portions to permit movement of said cover section relative to said base section between a closed position wherein said base and cover sections are in facing relationship and cooperate to define a compartment for receiving an assembled crossbow and an open position wherein said cover section is moved away from said base section to permit access to the crossbow;

retainer means for releaseably securing the crossbow with the stock in an upright position to said base section inside said compartment;

fastener means for releasably fastening said base and cover sections together along the other two of said edge portions when said cover section is in the closed positions; and a strip of wear resistant material on the inner surface of said base section and on the inner surface of said cover section and extending longitudinally substantially between the juncture of said side edge portions and said end edge portion and at a location corresponding to that of the crossbow stock when the crossbow is secured on said base section.

2. A carrying case according to claim 1 further including retainer means for releasably securing a quiver and a crossbow cocking mechanism to said base section inside said compartment.

3. A carrying case according to claim 1 including a pocket on the inner surface of said base section for holding crossbow accessories and having a releasably closable flap.

4. A carrying case according to claim 1 wherein said retainer means comprises a first pair of longitudinally spaced tie down straps secured to the inner surface of said base section at locations corresponding to the vicinity of the narrowed hand grip section of the crossbow stock and to the vicinity of the portion of the crossbow immediately forward of the forehand grip of the crossbow stock, each of said crossbow tie down straps having opposed free end portions with a combined length sufficient to surround respective portions of the crossbow; and gripping means on said free end portions of said crossbow tie down straps adapted to permit said free end portions to adjustably and releasably grip each other.

5. A carrying case according to claim 4 including a second pair of longitudinally spaced tie down straps secured to the inner surface of said base section at locations laterally spaced from one side of said crossbow tie down straps and corresponding to longitudinally spaced portions of a quiver, each of said quiver tie down straps having opposed free end portions with a combined length sufficient to surround respective portions of the quiver;

a third pair of longitudinally spaced tie down straps secured to the inner surface of said base section at locations laterally spaced from the other side of said crossbow tie down straps and corresponding to longitudinally spaced portions on a cocking mechanism, each of said cocking mechanism tie down straps having opposed free end portions with a combined length sufficient to surround respective portions of the cocking mechanism; and gripping means on said free end portions of said quiver and cocking mechanism tie down straps adapted to permit said free end portions to adjustably and releasably grip each other.

6. A carrying case according to claim 1 including a first handle secured to at least one of said base and cover sections at a location adjacent a said side edge portion intermediate said end edge portion and the juncture between said side edge portions; and a second handle secured to at least one of said base and cover sections at a location near the juncture of said side edge portions.

7. A carrying case according to claim 1 including a shoulder carrying strap having one end secured to one of said base and cover sections near the juncture of said side edge portions and the opposite end secured to one of said base and cover sections near the juncture of said side edge portion and said end edge portion.

8. A carrying case according to claim 1 wherein said base and cover sections comprise panels of flexible material joined together along said side edge portions.

9. A carrying case according to claim 8 wherein said fastener means comprises a zipper extending along substantially the entire length of said side edge portions.

10. A carrying case for an assembled crossbow including a stock comprising opposed base and cover sections made from sheets of a flexible material and having a generally triangular shape, an end portion and a pair of side edge portions diverging toward said end edge portion and each having opposite ends, a first end joining said end edge portion and a second end joining said second end of the other side edge portion;

an end section interconnecting said base and cover sections along said end edge portion to permit movement of said cover section relative to said base section between a closed position wherein said base and cover sections are in facing relationship and cooperate to define a compartment for receiving an assembled crossbow and an open position wherein said cover is folded back away from said base section to permit access to the crossbow;

fastener means for releaseably fastening said base and cover sections together along said side edge portions when said cover section is in the closed position;

retainer means for releaseably securing the crossbow, a quiver carrying arrows and a crossbow cocking mechanism to said base section inside said compartment including a first pair of longitudinally spaced tie down straps secured to the inner surface of said base section at locations corresponding to the vicinity of the narrowed hand grip section of the crossbow stock and to the vicinity of the portion of the crossbow immediately forward of the forehand grip of the crossbow stock, each of said crossbow tie down straps having opposed free end portions with a combined length sufficient to surround respective portions of the crossbow;

a second pair of longitudinally spaced tie down straps secured to the inner surface of said base section at locations laterally spaced from one side of said crossbow tie down straps and corresponding to longitudinally spaced portions of a quiver, each of said quiver tie down straps having opposed free end portions with a combined length sufficient to surround respective portions of the quiver, and a third pair of longitudinally spaced tie down straps secured to the inner surface of said base section at locations laterally spaced from the other side of said crossbow tie down straps and corresponding to longitudinally spaced portions on a cocking mechanism for the crossbow, each of said cocking mechanism tie down straps having opposed free end portions with a combined length sufficient to surround respective portions of the cocking mechanism;

gripping means on said free end portions of said crossbow, quiver and cocking mechanism tie down straps adapted to permit said free end portions to adjustably and releaseably grip each other; and a strip of wear resistant material on the inner surface of said base section and on the inner surface of said cover section and extending substantially between the juncture of said side edge portions and said end edge portion and at a location corresponding to that of the crossbow stock when crossbow is secured to said base section.

11. A carrying case according to claim 10 including a strip of wear resistant material on the inner surface of said end section at a location corresponding to the end of the crossbow stock.

12. A carrying case according to claim 11 wherein said fastener means comprises a zipper extending along substantially the entire length of said side edge portions.

13. A carrying case according to claim 12 including a pocket on the inner surface of said base section for holding crossbow accessories and having a closeable flap.

14. A carrying case according to claim 12 including a first handle including a pair of straps of flexible material respectively secured to said base and cover sections at a location adjacent a said side edge portion intermediate said end edge portion and a juncture between said side edge portions;

a second handle including a pair of straps of flexible material respectfully secured to said base and cover sections at a location near the juncture of said side edge portions; and a shoulder carrying strap of flexible material having one end secured to said base section near the junction of said side edge portion and the opposite end secured to said base section near the juncture of said side edge portion and said end edge portion.

* * * * *